United States Patent [19]

Castro et al.

[11] Patent Number: 4,571,756

[45] Date of Patent: Feb. 25, 1986

[54] FOLDAWAY HEADREST FOR CONVERTIBLE FURNITURE

[76] Inventors: Bernard Castro, 296 S. Down Rd., Lloyd Harbor, N.Y.; John Barabas, 50 Nassau Terminal Rd., New Hyde Park, N.Y. 11040; Ralph Boccella, 906 Polk Ave., Franklin Square, N.Y. 11010

[21] Appl. No.: 612,904

[22] Filed: May 22, 1984

[51] Int. Cl.[4] ..... A47C 17/00

[52] U.S. Cl. ..... 5/53 R; 5/53 D; 5/13

[58] Field of Search ..... 5/13 R, 28, 29, 53 R, 5/53 B, 53 D, 178–180

[56] References Cited

U.S. PATENT DOCUMENTS

| | | | |
|---|---|---|---|
| 1,074,799 | 10/1913 | Kindel | 5/53 D |
| 2,691,780 | 10/1954 | Bebry et al. | 5/13 |
| 3,024,473 | 3/1962 | Bebry et al. | 5/13 |

*Primary Examiner*—Kenneth J. Dorner
*Assistant Examiner*—Michael F. Trettel
*Attorney, Agent, or Firm*—Pasquale A. Razzano

[57] ABSTRACT

A convertible sofa bed mechanism is disclosed which is adapted to be mounted in a frame and includes a foldable bed frame having at least a leg and a head section articulated together for folding within the frame. The head section is rigid and is adapted to move between a first storage and a second sleep position parallel to its first position. The linkage mechanism mounts the bed frame in the sofa frame and operates to move the bed frame between folded and unfolded positions. The linkage mechanism includes a mobile link which moves at least in pivotal rotation during movement of the head section between its first and second positions. A headboard is pivotally mounted on the head section and extends across the frame. An operating link pivotally connected at opposite ends to the headboard and the mobile link moves the headboard from a position parallel to the head section of the bed frame in its first position to a position perpendicular thereto in the second position in response to movement of the mobile link so that, in the unfolded position of the mechanism, the headboard is presented in the desired position.

3 Claims, 6 Drawing Figures

10
12
14
16
18
20
22
24
25
26
27
28
30
32
34

FOLDAWAY HEADREST FOR CONVERTIBLE FURNITURE

BACKGROUND OF THE INVENTION

1. Field of the Invention

The present invention relates to convertible sofa bed constructions, and more particularly, to a convertible sofa bed mechanism in which a headboard is provided.

Convertible sofa beds are a popular addition to most homes because they provide additional sleeping accommodations without the requirement of an additional bedroom. One problem with many sofa beds is that the mechanism does not provide for a headboard such as most free standing beds have. As a result, during sleep, a pillow can move into the space between the head end of the frame and the sofa back cushions, making the sofa bed uncomfortable to use. In addition, since most sofa bed mechanism headboard frames are formed of metal and since they have a metal end frame at the head of the bed, the absence of a headboard will often cause the person sleeping in the bed to hit his head against the metal end frame.

While some sofa bed mechanisms in the past have provided for headboards, these mechanisms have all been fairly complex and difficult to provide in the confined space of a sofa with the attendant complex folding bed mechanism.

A series of such folding bed mechanisms with headboard were developed by Peter P. Bebry and disclosed in U.S. Pat. Nos. 2,624,888; 2,734,201; and 2,783,478. In each of these sofa beds, an extremely complex mechanism was provided having multiple parts whose complexity make them fairly expensive and require additional space and bulk in the sofa. A somewhat similar folding bed mechanism with the headboard is shown in the Lenart patent, No. 2,829,381. In this system, the headboard does not fold and thus requires additional space in the sofa. A similar headboard with a different folding mechanism is shown in U.S. Pat. No. 2,960,698 to Bernard Castro.

Still other headboard arrangements, wherein the headboard lies flat beneath the seating surface of the sofa are shown in U.S. Pat. Nos. 3,654,642 to Barabas and 1,649,719 to Meisner. And, a mechanism with a fixed headboard is shown in U.S. Pat. No. 2,934,770 to Willis et al.

An object of the present invention is to provide a simple headboard arrangement in a presently available commercial sofa bed mechanism which requires no modification of the existing mechanism to accommodate the headboard.

Yet another object of the present invention is to provide a headboard in a folding sofa bed mechanism which is extremely simple in operation and adaptable to existing mechanisms.

A further object of the present invention is to provide a headboard in a folding sofa bed mechanism with a minimum of expense.

A further object of the present invention is to provide a headboard arrangement in a sofa bed mechanism wherein the headboard is compact and requires substantially no additional space to be accommodated within the sofa frame.

BRIEF DESCRIPTION OF THE INVENTION

In accordance with an aspect of the present invention, a convertible sofa bed having an articulated frame, a back rest and a cavity in the frame below the back rest is provided in which a foldable bed frame can be mounted. The articulated bed frame supports a mattress and includes at least a head section and a leg section articulated together for folding into the cavity of the frame. The head section of the frame includes a head end portion with a linkage operating mechanism mounting the bed frame in the sofa frame and moving the frame between an extended sleep position and a folded position within the sofa frame cavity.

The operating linkage mechanism includes a mobile link which moves at least in pivotal rotation during movement of the frame between the sleep or extended and the folded positions. A headboard is pivotally mounted on the head section and extends across the head frame. An operating link is pivotally connected at opposed ends to the headboard and the mobile link to move the headboard from a position in which it lies generally parallel to the head section in the folded position of the frame and a position generally perpendicular to the head section, in front of the back rest in the extended position of the frame in response to movement of the link.

The above and other objects, features and advantages of the present invention will be apparent in the following detailed description of a preferred embodiment of the invention when read in conjunction with the accompanying drawings wherein.

Figures 1, 2:
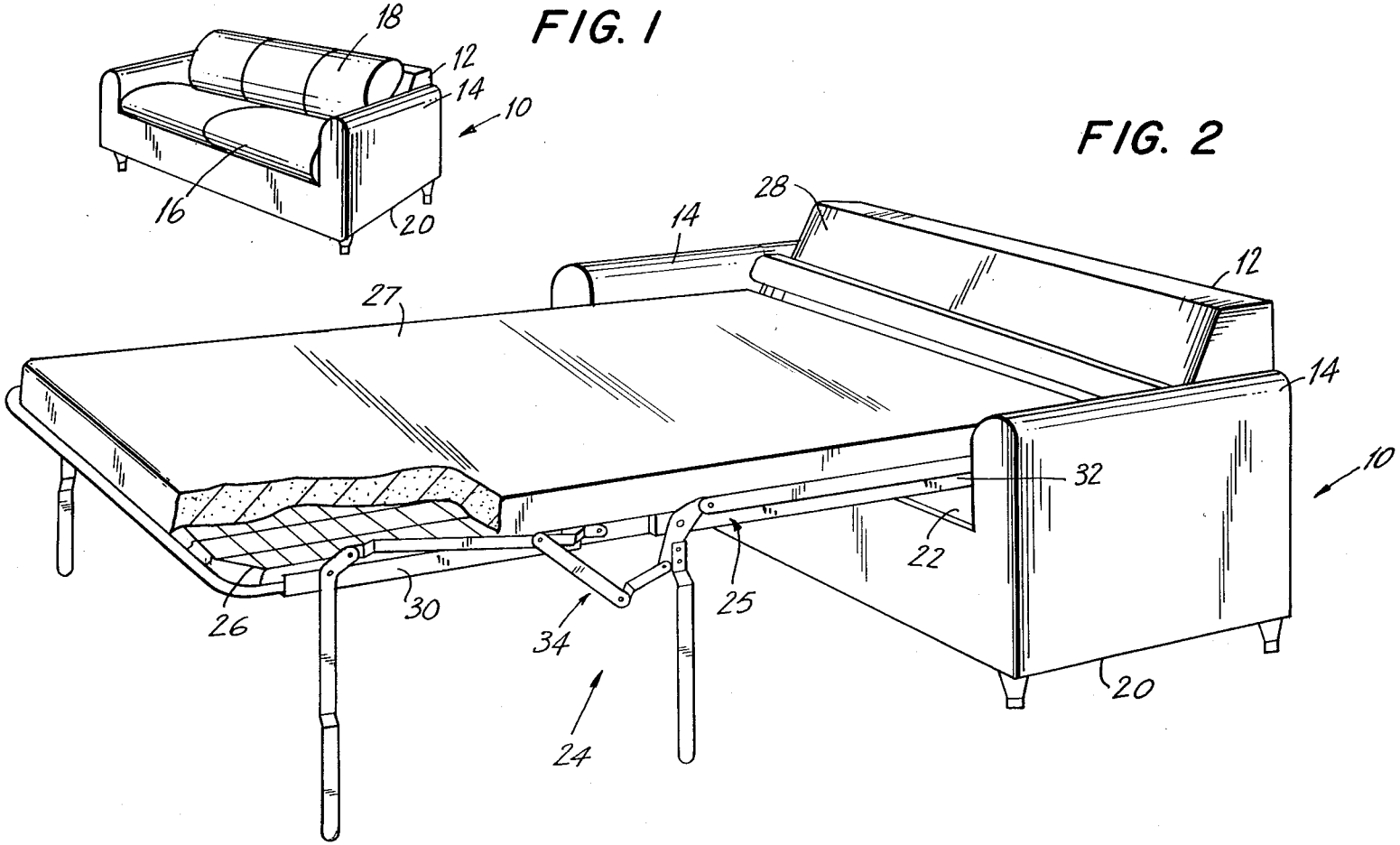
FIG. 1 is a perspective view of a sofa bed constructed in accordance with the present invention.
FIG. 2 is an enlarged perspective view showing the sofa mechanism in its unfolded or extended position with the headboard in place.

Referring now to the drawings in detail and, initially, to FIG. 1 thereof, a convertible sofa bed 10 is illustrated which includes an upholstered frame having a back 12 and arms 14 with removable seat cushions 16 and back cushions 18. The back cushions 18 may either be removable or can be fixed in place, as desired.

The sofa bed includes a frame which forms the back and arms 12, 14 and the base 20. The frame is typically formed of wood and upholstered in any known convenient manner. The frame defines a cavity 22 below the seat cushions in which the convertible sofa mechanism 24 is mounted.

When it is desired to use sofa bed 18 as a bed instead of a sofa, seat cushions 16 are removed and the bed mechanism 24 stored beneath the seat platform is lifted and swung out of the sofa frame until it is in the horizontal position shown in FIG. 2. The convertible sofa mechanism includes a metal frame 25 which supports a spring mounted wire mesh 26 which, in turn, supports a mattress 27.

The sofa bed mechanism illustrated in FIG. 2 is of conventional construction, except as described hereinafter with respect to the headboard 28 of the device.

This mechanism is commercially available in convertible sofa beds presently sold by the Castro Convertible Corporation, and is generally described in U.S. Pat. No. 3,654,642. Accordingly, the mechanism need not be described in detail herein. However, the mechanism does include at least a leg section 30 and a head section 32 which is articulated through the action of intermediate linkage sections and operating mechanism 34 to permit the sections to be folded in generally overlapping relationship and moved into the cavity 22 for storage.

Figure 3:
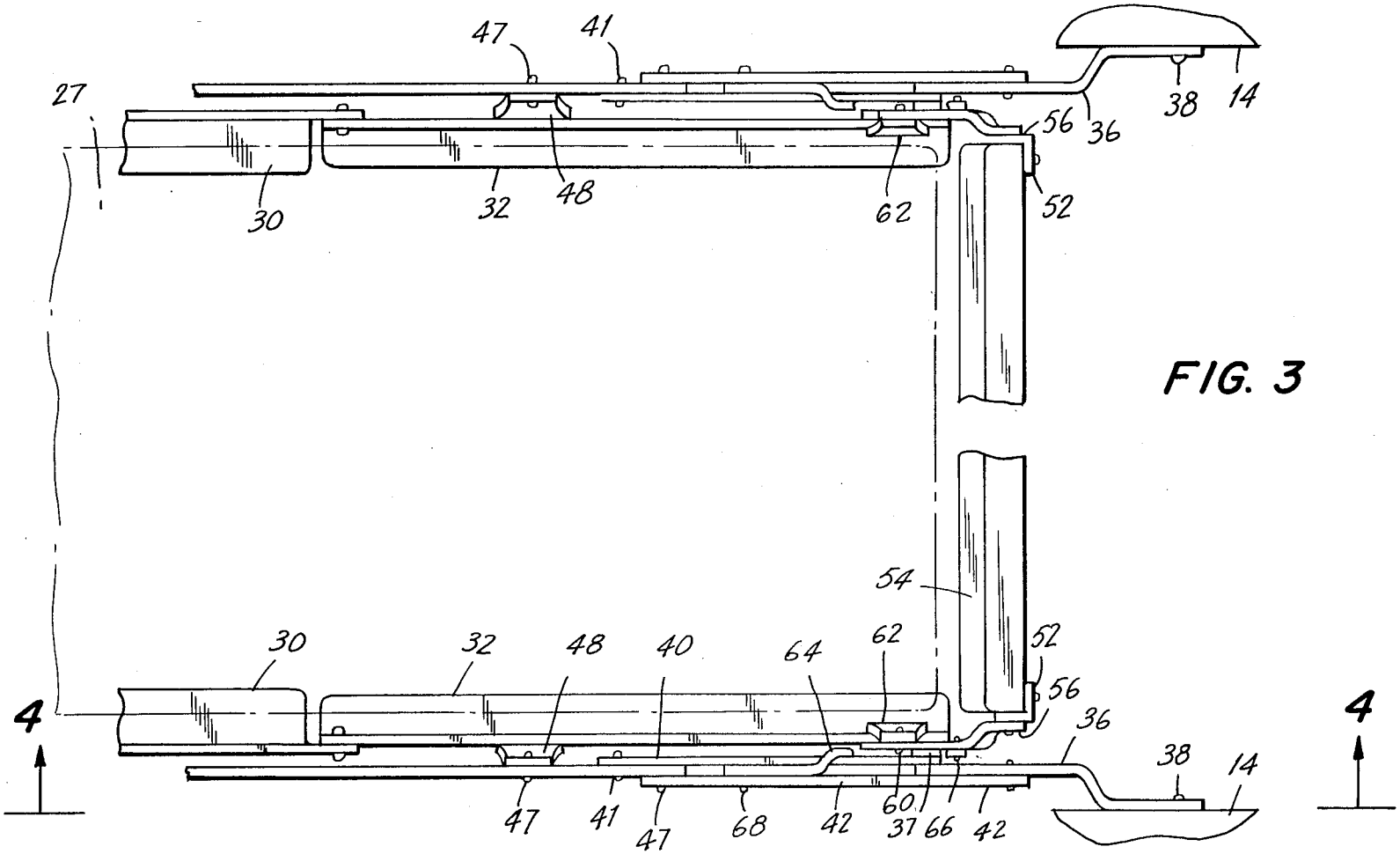
FIG. 3 is a partial plan view of the operating mechanism of the sofa bed shown in FIG. 2 in its extended position.
Figure 4:
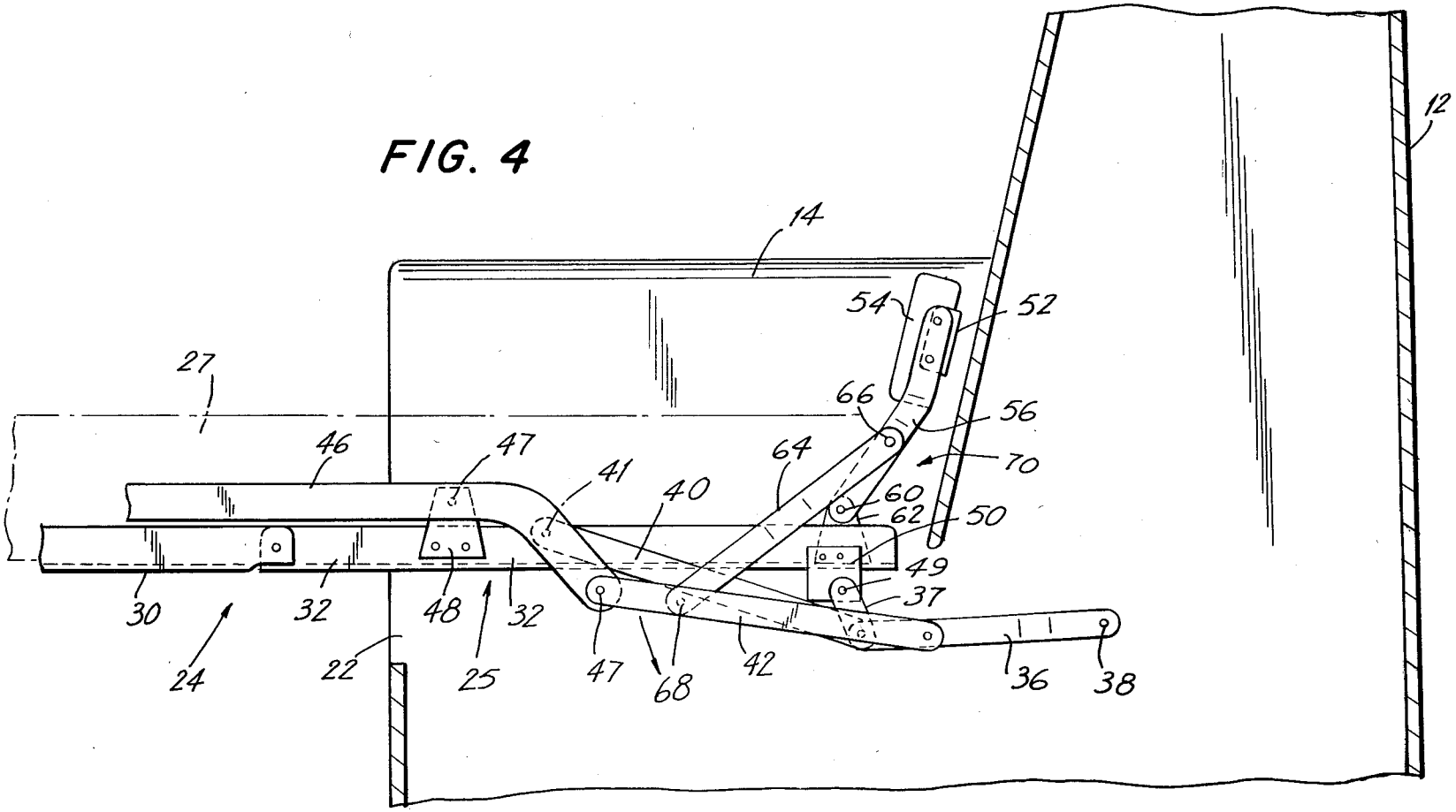
FIG. 4 is a partial side view of the sofa bed mechanism with the headboard in its raised position, as shown in FIG. 2.
Figure 5:
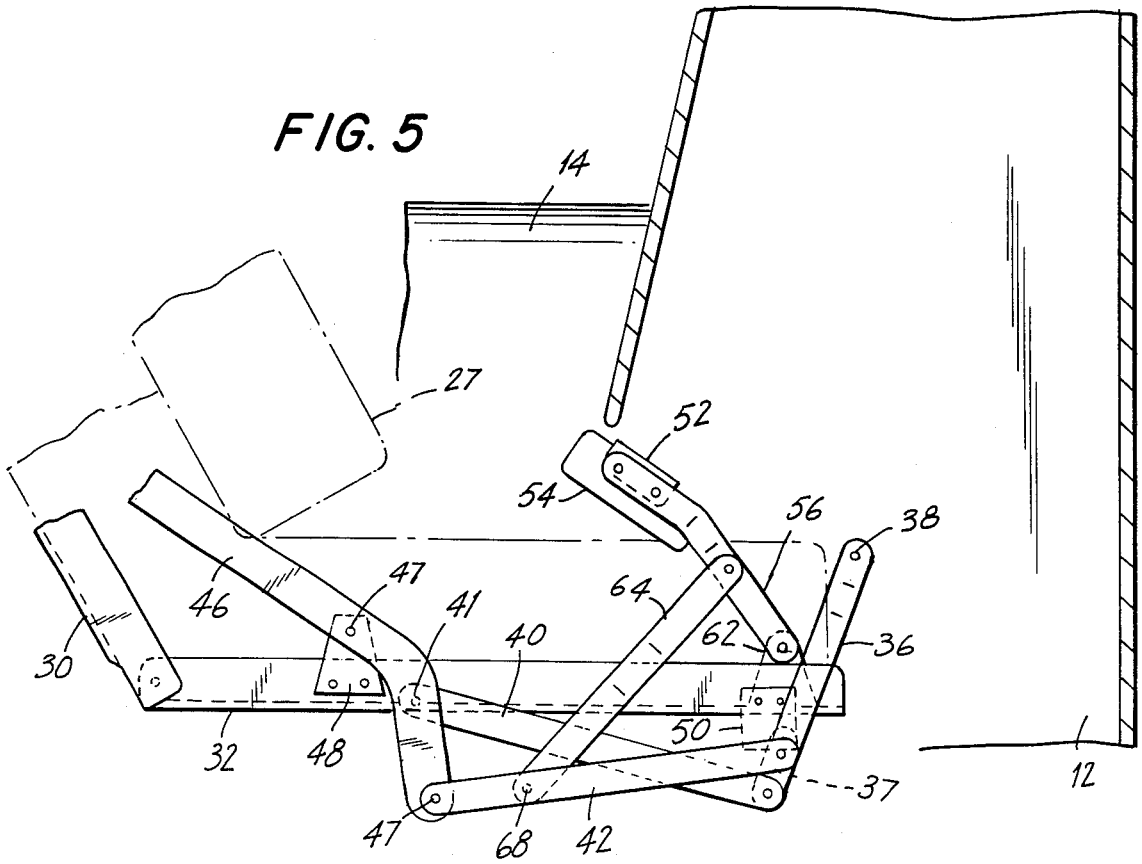
FIG. 5 is a partial side view similar to FIG. 3 showing the mechanism in a partly folded position.
Figure 6:
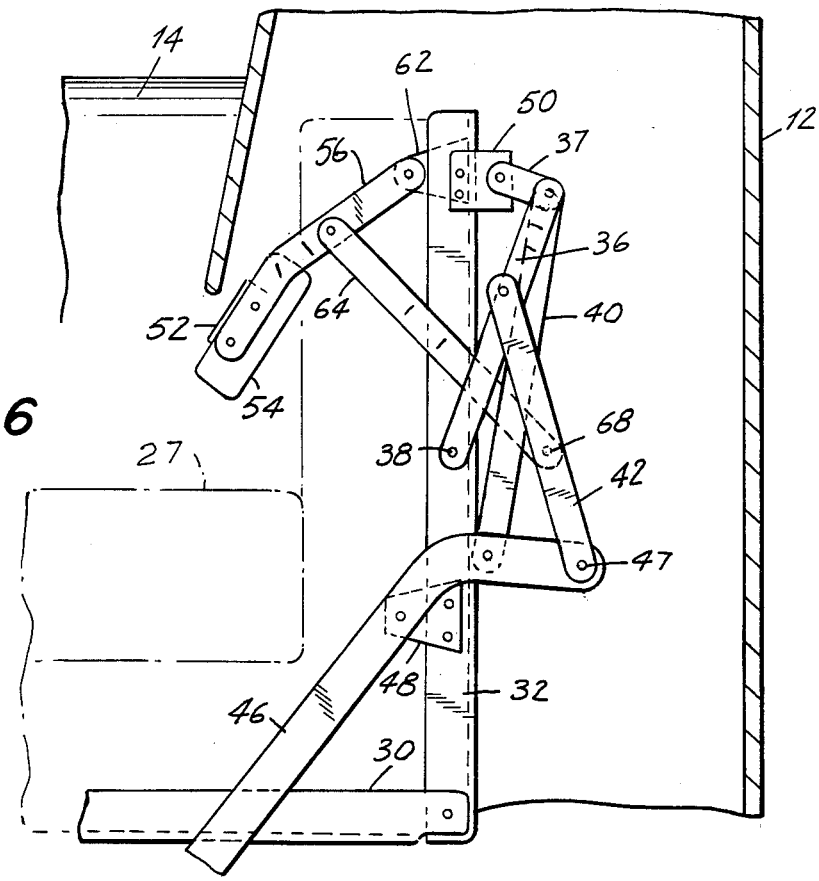
FIG. 6 is a side view similar to FIGS. 4 and 5 showing the headboard in its folded or storage position when the sofa is closed.

In the unfolded or extended position of the mechanism, as seen in FIG. 3, the head frame section 32 occupies a position in which the frame is exposed between the arms 14 of the sofa adjacent the lower level of the back rest or back cushions 18. The conventional Castro mechanism includes a rear or first operating link 36 which is pivotally connected at 38 to the interior sides of the frame of the sofa. There is one of these links on each side of the bed mechanism. Indeed, all of the links to be described with respect to FIGS. 4–6 are duplicated in mirror images on opposite sides of the frame.

Link 36 is pivotally connected at its opposite end to a swing link 37 and another link 40 by a conventional pivot pin or the like in a known manner. A further link 42 is pivotally connected, as shown, to rear link 36 and to the lower portion of the curved end of an operating or pusher link 46 at point 47. Link 40 is also pivotally connected to link 46 at 41. Link 46 is pivotally connected at 47 to mounting tab 48 on the head frame section 32. Swing link 37 is pivotally connected at 49 to a downwardly extending tab 50 secured to frame section 32.

This linkage mechanism operates in a known manner to guide the sofabed mechanism in a relatively low trajectory so that it easily passes beneath the backrest of the sofa frame.

In accordance with the present invention, headboard 28 is mounted on the head section 32 of the frame. The headboard or headrest includes a mounting board 52 which extends transversely across frame section 32. The front face 54 of the board is upholstered in any convenient and known manner. A pair of support links or bars 56 are pivotally mounted on the sides of the headboard with their bottom ends 58 pivotally connected at 60 through a pivot pin or the like to an upstanding mounting bracket 62 on the head frame. A link 64 is pivotally connected at its opposed ends 66, 68 through conventional pivot pins to the support bar 56 and the mobile link 42 of the sofa bed mechanism. In the unfolded or extended position of the sofa bed mechanism, link 64 moves the headrest into the position illustrated in FIG. 3 and locks it rigidly in that position, where it serves to prevent a person lying on the bed from inadvertently pushing his pillow into the recess 70 between the bed frame and backrest of the sofa or from having his head soil the upholstering material of the sofa back 18.

When the sofa bed is folded from its operating position to its storage position, the links 44, 42 move through the positions shown in FIG. 5 and assume the position shown in FIG. 6. It will be appreciated that, as the link 42 pivots from the position shown in FIG. 4 to the position shown in FIG. 6, it draws with it the link 64 which, in turn, causes the headrest 28 to pivot from the position shown in FIG. 4 to the storage position shown in FIG. 5 in which it overlies the mattress. In addition, as the mechanism folds, the entire head frame section 32 moves from the position shown in FIG. 4, first downwardly to the position shown in FIG. 5 and thence upwardly into the rear of the sofa into the position shown in FIG. 6. As a result, the headboard mechanism is stored in and beneath the backrest out of the way of the seating area of the sofa, whereby it does not interfere with or irritate persons sitting on the sofa. At the same time, the headboard mechanism is stored in a compact manner and does not require additional space at the back of the sofa or within the sofa cavity, as compared to ordinary mechanisms previously available without a headrest.

This folding mechanism with the headrest in the position described above is far less complex and less expensive to manufacture than previously proposed headrest structures used in other forms of convertible sofa mechanisms. And, it requires no modification of conventionally available mechanisms or sofa frames.

Although the present invention has been described herein in detail with reference to the accompanying drawings, it will be appreciated that various changes and modifications may be effected therein by those skilled in the art without departing from the scope or spirit of this invention.

What is claimed is:

1. In a convertible sofa bed having a frame, a backrest and a cavity in said frame below said backrest, a foldable bed frame adapted to support a foldable mattress and including a head section and a leg section articulated together for folding into the cavity of said froms, said head section being rigid and having a head end portion which is adjacent said backrest when the bed is unfolded, a linkage operating mechanism for mounting said bed frame in the sofa frame and moving said frame between an extended sleep position and a folded position within said cavity wherein said head end portion of the head section is within said backrest; said linkage mechanism including first operating link pivotally connected at one end to the sofa bed frame, a swing link pivotally connected at one end to the opposite end of said first operating link and at its other end to said head section; a main operating link pivotally connected to said head section and extending therealong towards said leg section; and first and second connector links made having forward and rear ends; the forward end of the first connector link being pivotally connected to an end of said main operating link adjacent said head section and its rear end being pivotally connected to said first operating link between its ends; the forward end of the second connector link being pivotally connected to said main operating link forwardly of the connection thereto of said first connector link, away from the backrest and its rear end being pivotally connected to both said first operating link and said swing link at the pivotal connection therebetween; said first connector link moving at least in pivotal rotation during movement of said head section between said first and second positions, a headboard pivotally mounted on said head section and extending across said head frame, and a head section operating link pivotally connected at opposed ends to said head board and to said first connector link at a position between its ends and forward of said swing link away from said backrest, to move said head board from a position in which it lies generally parallel to said head section in the folded position of the frame and a position generally perpendicular to the head section and in front of the backrest in said extended sleep position of the frame, in response to movement of said mobile link.

2. A convertible sofa mechanism as defined in claim 1 wherein said first connector link moves in both rotation and translation.

3. A convertible sofa as defined in claim 2 wherein said headboard is mounted on the frame to overlie said mattress in said folded position.

* * * * *